US007220931B2

(12) United States Patent
Bouvier et al.

(10) Patent No.: US 7,220,931 B2
(45) Date of Patent: May 22, 2007

(54) SWITCHING DEVICE WITH INTEGRATED LIGHT SOURCE

(75) Inventors: Laurent Bouvier, Monnieres (FR); Laurent Kubat, Dole (FR); Sylvain Rochon, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 21 days.

(21) Appl. No.: 11/176,506

(22) Filed: Jul. 7, 2005

(65) Prior Publication Data

US 2005/0263381 A1 Dec. 1, 2005

Related U.S. Application Data

(63) Continuation-in-part of application No. PCT/IB03/06343, filed on Dec. 30, 2003.

(30) Foreign Application Priority Data

Jan. 10, 2003 (FR) ..... 03 00267

(51) Int. Cl.
*H01H 9/20* (2006.01)

(52) U.S. Cl. ..... 200/314

(58) Field of Classification Search ..... 200/406, 200/516, 16 A–16 D, 405, 408, 449, 450, 200/513, 520, 308, 310–317
See application file for complete search history.

(56) References Cited

U.S. PATENT DOCUMENTS

| | | | | |
|---|---|---|---|---|
| 4,365,120 | A * | 12/1982 | Pounds | 200/5 A |
| 4,751,385 | A | 6/1988 | Van Benthusysen et al. | |
| 5,201,408 | A * | 4/1993 | Torma et al. | 200/294 |
| 6,114,644 | A * | 9/2000 | Nishikawa | 200/406 |
| 6,262,383 | B1 * | 7/2001 | Nishikawa | 200/406 |
| 6,310,308 | B1 * | 10/2001 | Watson et al. | 200/520 |
| 6,987,233 | B2 * | 1/2006 | Cole et al. | 200/341 |

FOREIGN PATENT DOCUMENTS

| | | |
|---|---|---|
| DE | 298 19 520 | 2/1999 |
| DE | 100 29 417 | 8/2001 |
| FR | 2 652 945 | 4/1991 |

* cited by examiner

*Primary Examiner*—Michael A. Friedhofer
(74) *Attorney, Agent, or Firm*—Peter Van Winkle

(57) ABSTRACT

A switching device which includes a lighting source (18) having an SMC (surface mounted component) type light emitting diode, which includes a pair of connection members (52) with base portions (82) each soldered or otherwise joined to a plate (76) of the SMC diode. The connection members have right angle bends (88) and pin portions (86) extending down from the bends. The lighting source lies within a switch mechanism (16) and within an operating member (14), with the pin portions projecting through channel portions (61) of an insulative casing into holes in energizing conductors (40).

18 Claims, 3 Drawing Sheets

SWITCHING DEVICE WITH INTEGRATED LIGHT SOURCE

CROSS-REFERENCE

This is a continuation-in-part of PCT application PCT/IB 2003/006343 filed 30 Dec. 2003 which named the United States and which claimed priority from French application 0300267 filed 10 Jan. 2003.

BACKGROUND OF THE INVENTION

The present invention relates to a switching device of the type comprising a casing forming a cavity, a switching mechanism in the casing and an operating member for operating the switching mechanism. A light source carried by the casing is connected to energizing conductors. The light source comprises a LED (light emitting diode) element and at least two connection members extending at least partially through the casing to the energizing conductors. The light source illuminates a control button of the operating member.

In order to be visible from the operating region at which the control button is pushed, the light source must be positioned outside the switching mechanism. The LED is commonly constructed with a transparent head that contains a light-emitting semiconductor element. The LED element is connected to a pair of conductors that are embedded in the transparent head and that have free ends forming flat conductive connection areas on a side of the transparent head. Such flat connection areas are suitable for surface mounting on a circuit board by direct soldering to traces on the circuit board. Such LED's are widely available at moderate cost.

In practice, the internal region of the casing of the switching device is occupied by the switching mechanism. In a switching device where the control button is depressed, or pushed down, the presence of the LED can result in a tall switching device.

A major object of the invention is to provide a low cost switching device with a light source that is compact in height.

SUMMARY OF THE INVENTION

The present invention provides a compact switching device with a SMC-type (surface mounted component type) light-emitting diode (LED) element, of the type that has a body and at least two flat, conductive and coplanar connection plates on the body. The switching device includes a pair of contacts, or connection members that each comprises a base portion that is conductively joined (e.g. by solder or an ultrasonic weld) to one of the connection plates of the LED element. Each connection member also has a pin portion that projects deeply into the casing and below the switching mechanism where it connects to an energizing conductor that supplies electricity. The switching device can include one or a plurality of the following characteristics:

each base portion is ultrasonically welded to the associated connection plate;

each pin portion comprises an arm and comprises a foot extending primarily parallel to each other at a bend of almost 180°, and engaged with one of the energizing conductors;

the casing comprises at least two partition walls which project up into a cavity of the casing and which form channel portions between them into which the pin portions of the connection members are inserted and where they are held;

the foot of each pin portion has a locking tooth that engages one of the casing partitions in order to fix the position of the light source;

the light-emitting diode bears against a top end of at least one partition wall;

each energizing conductor has a perforation, or hole, through which the corresponding pin portion projects and where the pin portion is conductively joined to the energizing conductor.

Other characteristics and advantages of the invention will become apparent from reading the detailed description which follows for the understanding of which reference will be made to the appended drawings.

DESCRIPTION OF THE PREFERRED EMBODIMENTS

Figure 1:
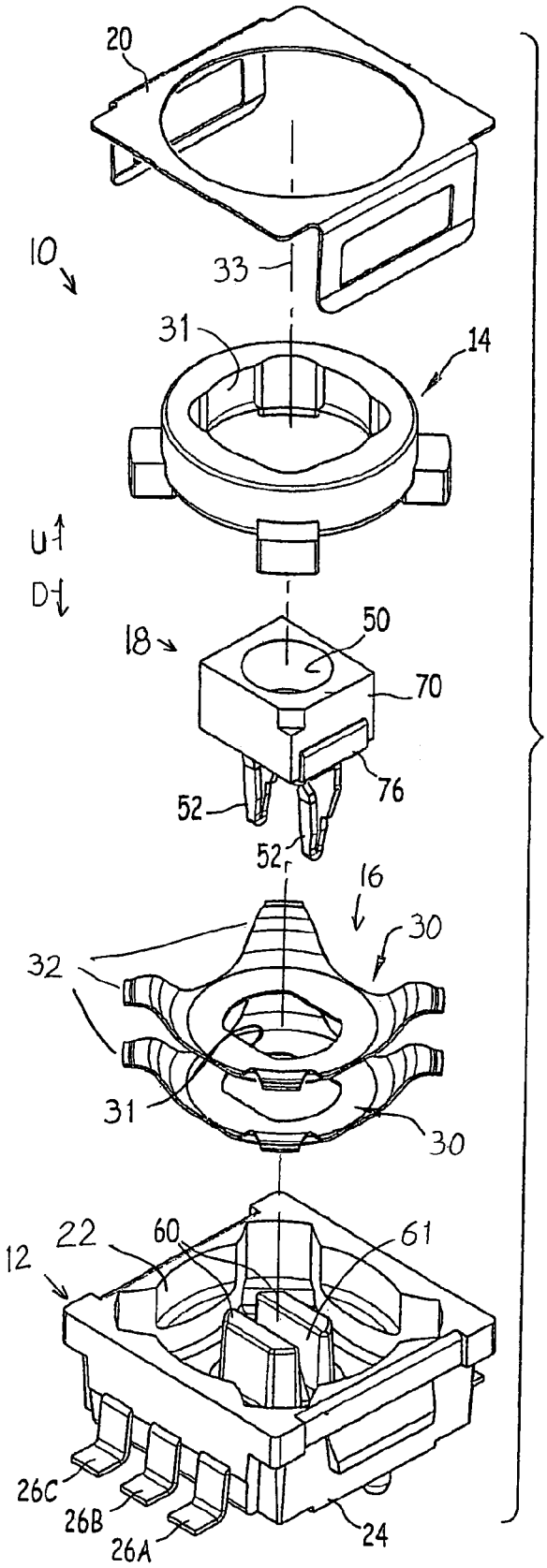
FIG. 1 is an exploded isometric view of a switching device according to the invention.
Figure 2:
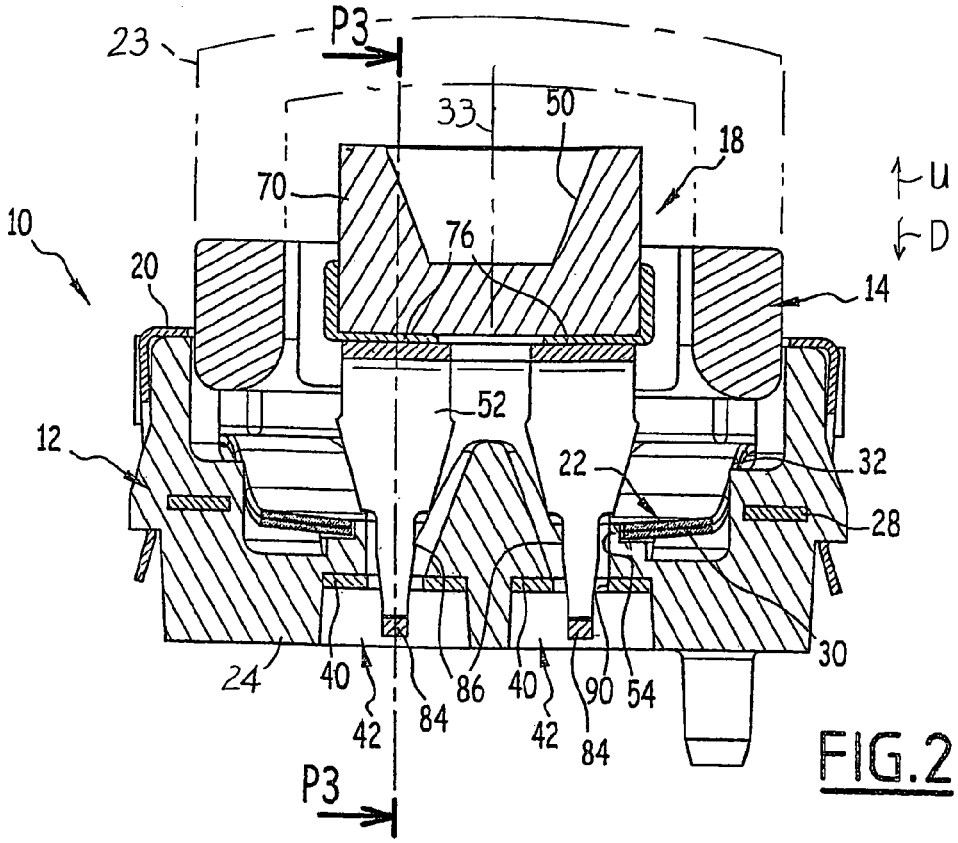
FIGS. 2 and 3 are sectional views taken on the planes P2—P2 and P3—P3, respectively, of the switching device illustrated in FIGS. 2 and 3.

FIG. 1 shows a switching device 10 that includes a casing 12, an operating member 14 movable relative to the casing 12, and a switching mechanism 16 housed in the casing 12. The switching device also includes a light source 18 and a frame 20 for securing the operating member 14 and the switching mechanism 16 in the casing. A transparent push-button indicated at 23 in FIG. 2, is fitted on the operating member 14, over the light source 18, to improve visual appearance and facilitate operating when the switching device is installed in an electronic apparatus, particularly a portable telephone. In the drawings, arrows U and D designate upward and downward directions, and it is assumed that the button 22 is pushed downward to operate the switch.

Figure 5:
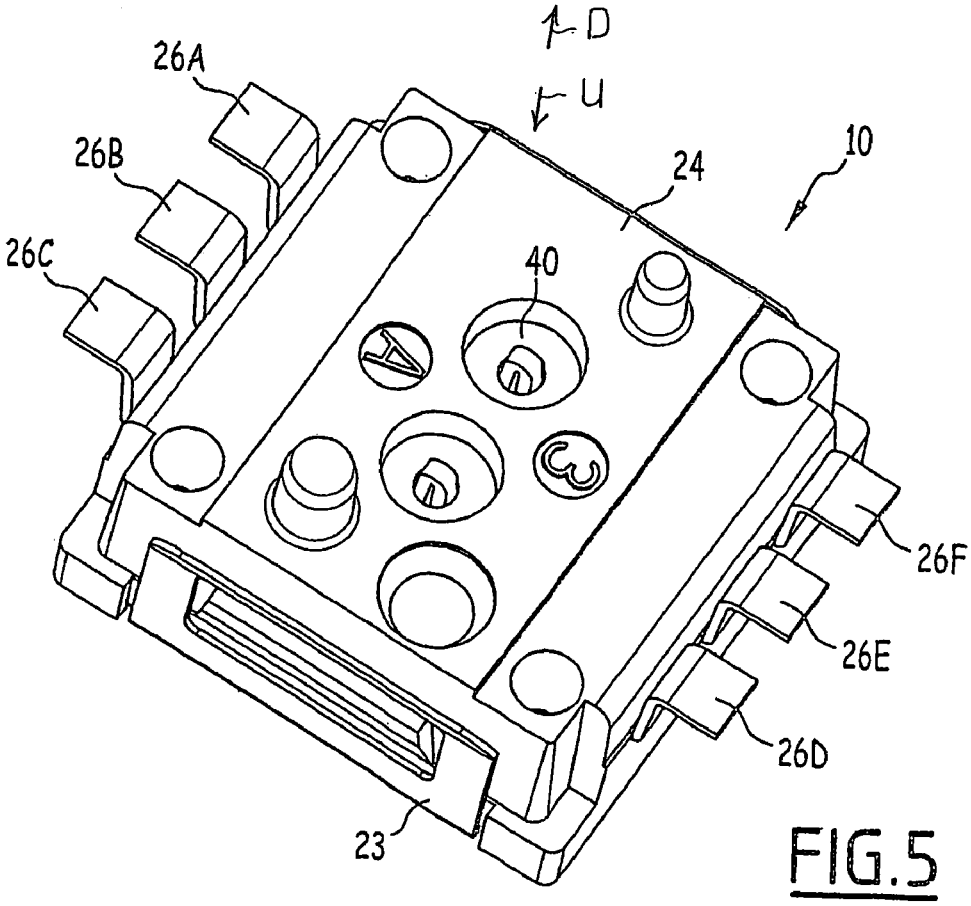
FIG. 5 is a bottom isometric view of the assembled switching device of FIGS. 1–3.

The casing 12 is generally of parallelepipedal shape and formed of insulating plastic material. The casing forms a cavity 22 of generally cylindrical shape, closed at one end by a base 24. Six connection terminals 26A, 26B, 26C, 26D, 26E and 26F (FIG. 5) project laterally from opposite sides of the base 24, for mounting on a circuit board. Four of the terminals 26A, 26C, 26D, 26F are connected to a conductor 28 (FIG. 2) lying in the cavity 22 in the vicinity of the base 24.

The switching mechanism 16 (FIG. 1) which lies the cavity 22, comprises two superposed metal conductor switching plates 30 with central holes 31 that closely receive partitions 60 of the casing. The switching plates are identical and formed of sheet metal, and generally have convex surfaces with one convex surface lying on the base 24. The switching plates have four radially-projecting arms 32 for contacting conductors 28 (FIG. 2) to close circuits as is known in the prior art. At rest, the arms normally extend away from the conductors 28. The arms have to be resiliently deflected to be brought into contact with the conductors 28, which is accomplished by depressing the operating member 14.

Figure 3:
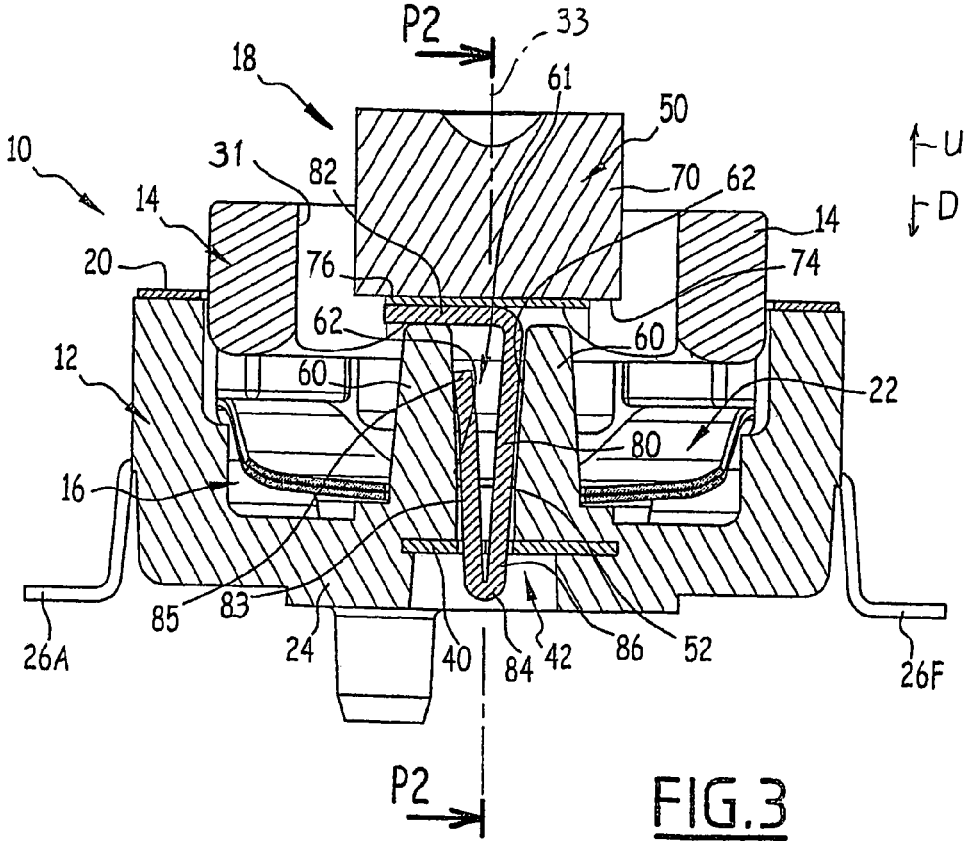

The operating member 14 generally has an annular shape defining an axial duct 31 (FIG. 3) for receiving the light source 18. The operating member 14 can be displaced by sliding it along the axis 33 (FIG. 2) of the cavity 22 to downwardly depress or release the arms of the conductor plates. In a conduction position in which the arms 32 of the plates 30 are in contact with the conductors 28, terminals 26A, 26C are in communication with the terminals 26D, 26F, respectively. In a rest position as illustrated in FIGS. 2 and 3, the arms of the plates 30 are separated from the conductors 28.

The light source 18 is electrically connected to two current-carrying energizing conductors 40 in the form of inserts at 40. The inserts are fixed firmly in the casing and connected to the connection terminals 26B and 26E by conductors embedded in the casing. The conductive inserts 40 extend on the bases under two recesses 42 that open downward to lower surface of the base 24 of the casing.

The light source 18 comprises an SMC-type light-emitting diode element 50 (FIG. 4) and two added contacts, or connection members 52. The diode element 50 illustrated is of the SMC (surface mounted component) type which is intended to be electrically connected (e.g. by solder) directly to the tracks of a printed circuit board. For this purpose, the diode device comprises flat conductive connection plates 76. The connection members 52 are suitable for being fixed firmly, in electrical connection joints, to the conductive inserts, or energizing conductors 40 (FIG. 3) that supply electricity to the LED. The inserts 40 extend through a central opening 54 (FIG. 2) in the conductive plates 30.

Figure 4:
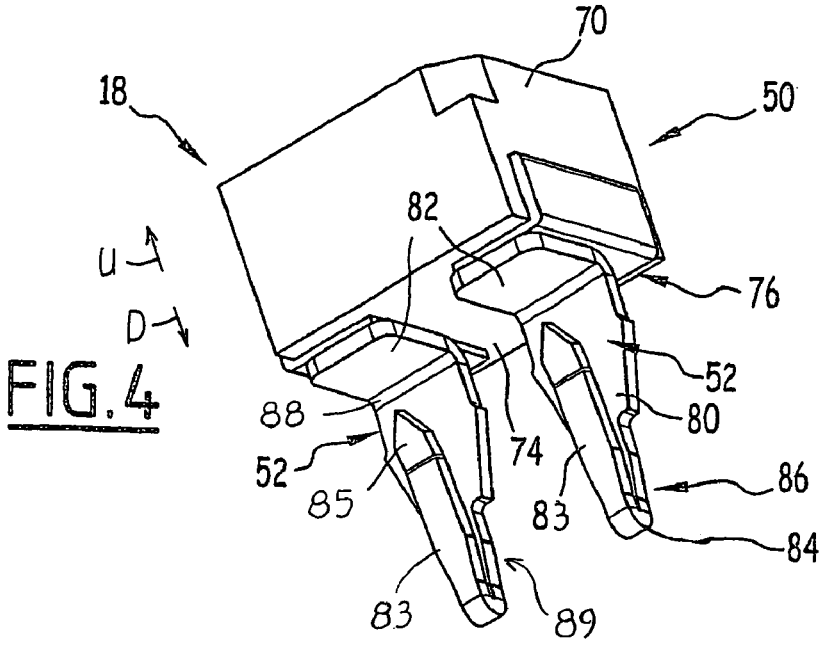
FIG. 4 is an enlarged isometric view of a first embodiment of a light source for the switching device of FIGS. 1 to 3.

The casing partitions 60 (FIG. 3) form channel portions 61 and lie above the energizing conductor conductive inserts 40. The inserts have holes under the channel portions for receiving the connection members 52 of the light source. The upper ends of the partitions 60 lie within the duct 31 of the operating member 14, and form a support surface for the light source. The facing surfaces 62 of the partitions converge downwardly D towards one another. As shown in FIG. 4, the light source 18 includes a generally parallelepipedal, transparent body 70 having a lower surface 74 and two coplanar surface mount connection plates 76 on the lower surface. The lower surfaces of the surface mount plates are flush with the lower surface 74 of the body 70 or project only slightly below the lower surface. The surface mount plates 76 (which are shown as parts of right angle bent sheets) extend in a common plane that is parallel to the lower surface 74.

As shown in FIG. 4, the connection members 52 are formed of blanked metal plates. Each connection member 52 has a base portion 82 that is electrically joined (e.g. by soldering, brazing, ultrasonic welding, etc.) to a surface of one of the surface mount plates 76. The electrical-mechanical joints are not shown. Each connection member also has a pin portion 86 connected by a 90° elbow or bend 88 to the base portion. Each pin portion 86 has an arm 80 and has a foot 83 joined to the arm at a bend 84 of more than 135°, and which approaches 180°. FIG. 3 shows that when the arm is installed in a channel portion 61 the arm 80 and foot 83 extend largely parallel. At its free end, which is furthest from the bend 84, the foot 83 forms a tooth 85 diverging away from the arm 80.

The width of the connection pin is reduced in a region 89 (FIG. 4) in the vicinity of the bend 84. The narrow region 89 is suitable for projecting into a perforation 90 (FIG. 2) formed through the base of the casing and through a hole in an energizing conductor 40. The pin portions 86 are preferably joined, as by solder, to the conductors 40 at the holes therein. To mount the pin portions 86 of the connection members, the pin portions are pressed down into the channel portions 61 (FIG. 3) of the casing. The arm 80 and foot 82 of each connection member are resiliently deflected closer together and resiliently bear against the downwardly converging surfaces 62 of the partition portions 60. The tooth 85 adds to resilience and holding. When the pin portions are fully inserted the base portions 82 bear against the upper end of the partitions 60. The electrical joint between the pin portion and energizing conductor lies entirely in the recess 42.

The use of a light source comprising an SMC-type light-emitting diode and added connection members provides a light source of reduced height.

Figure 6:
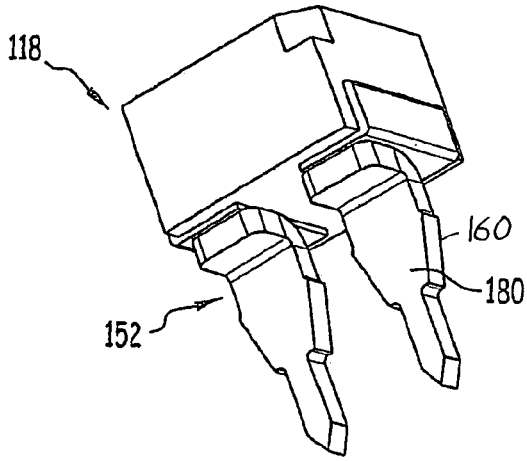
FIG. 6 is an isometric view, similar to that of FIG. 4, of a variant of the light source according to the invention.

FIG. 6, shows a variant 118 of a light source which differs from the light source of FIGS. 1–5 in that the connector members 152 have pin portions 180 that do not have almost 180° bends. The pin portions have tapered parts 160 that fit in tapered channel portions with the bottom of the pin passing through a hole in an energizing conductor that lies under the channel and soldered thereto to the energizing conductor.

Although terms such as "up" and "down" have been used to describe the switch device as it is illustrated, the switch device can be used in any orientation.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A switching device that has a casing with an upwardly opening cavity and a base lying under at least part of said cavity, a switching mechanism lying in said casing, an operating member that is moveable to operate said switching mechanism, a light mounted on said casing, and energizing conductors for carrying electricity to said light, said light including a surface mount light emitting diode element having a lower face with a pair of surface mount plates, comprising:

a pair of connection members for connecting said surface mount plates to said energizing conductors;

each of said connection members has a base portion lying facewise against and joined to one of said surface mount plates, and each of the connection member has a pin portion engaged with one of said energizing conductors.

2. The device described in claim 1, wherein:

said casing forms an upwardly-opening channel with opposite channel sides;

the pin portion of one of said connection members has an approximately 180° bend that forms primarily parallel arm and foot parts on opposite sides of said bend, with said arm and foot parts trapped between said opposite channel sides.

3. The device described in claim 2 wherein:

said channel sides extend at downward inclines toward each other.

4. The device described in claim 2 wherein:

one of said foot parts has a free end lying opposite said bend, said one of said food parts forming a tooth that is bent to extend away from said arm, a tip of said tooth pressing against one of said channel sides.

5. The device described in claim 2 wherein:

one of said energizing conductors lies at a bottom of said channel and has a hole, said pin portion projects through said hole with said bend lying below said hole, and said pin is connected to said one of said energizing conductors at said hole.

6. The device described in claim 1 wherein:

said casing has a pair of walls with wall tops forming a channel between them;

the pin portion of one of said connection members has an approximately 180° bend that forms primarily parallel arm and foot parts that extend from opposite sides of said bend, with said arm and foot parts trapped between said opposite channel sides;

a foot part of at least one of said connection members lie against one of said wall tops.

7. The device described in claim 1 wherein:

said casing has an upwardly-open channel with opposite channel side walls;

one of said energizing conductors lies under said channel and the energizing conductor has a hole;

one of said pin portions projects down through and below said channel and has a lower end that projects through said hole in the one of said energizing conductors and is joined at said hole to the energizing conductor.

8. The device described in claim 1 wherein:

said switching mechanism includes at least one switching plate with arms positioned to be downwardly deflected by said operating member, said switching plate having a central aperture, and said connection members protect down through said aperture.

9. A switching device comprising a casing, a switch mechanism lying in said casing, a depressable operating member for operating said switch mechanism, a light mounted on said casing, and first and second energizing conductors in said casing for supplying current to said light, wherein said light includes a surface mount light emitting diode element having a pair of flat surface-mount plates for receiving energizing current, including:

a pair of connection members each having a plate shaped base that is joined facewise against one of said surface-mount plates, each connection of the member having a pin that extends down to and is engaged with one of said energizing conductors.

10. The switching device described in claim 9 wherein:

said casing has channel walls that forms a pair of channel portions;

said energizing conductors each lies under one of said channel portions and has a hole;

said pins each projects through one of said channel portions and through one of said holes in one of said energizing conductors and is joined thereat to the energizing conductor.

11. The switching device described in claim 10 wherein:

each of said channel portions is tapered so each channel portion is progressively narrower at lower locations, and each of said pins is tapered to jam into one of said channel portions.

12. The switching device described in claim 9 wherein:

said casing has channel walls that form a pair of channel portions;

each of said pins has a bend of more than 135° to form primarily parallel arm and foot parts each extending largely upward from said bend, the arm and the foot part of each pin lying in one of said channel portions and pressing against the channel walls.

13. The switching device described in claim 9 wherein:

said casing has a pair of partition walls forming channel portions, said pins project through said channel portions;

said switch mechanism includes at least one plate with radiating arms position to be downwardly deflected by said operating member, said plate having a central aperture that closely receives said partition walls.

14. A switching device that has a casing with an upwardly opening cavity and a base lying under at least part of said cavity, said switching device including a switching mechanism lying in said casing which includes a moveable operating member, at least one switching plate with arms that are downwardly deflectable by said operating member, and a plurality of conductors positioned to engage said at least one switching plate including a conductor lying under one of said arms, and a light mounted on said casing and having a plurality of electrical connection member, wherein:

said at least one switching plate has a central hole, and said casing has a projection that projects into said hole and that form an upwardly-opening channel between them, and least one of said connection members projects downward into said channel.

15. The switching device described in claim 14 wherein:

both of said connection member projects downward through said channel and below said channel; and including a pair of energizing conductors lying under said channel, and each of the connection members has a lower end that is electrically connected to one of said energizing conductors.

16. The switching device described in claim 14 wherein:

at least one of said connection members has a bend of more than 135° that forms arms on opposite sides of said bend, with said arms pressing against opposite sides of said channel.

17. A switching device that has a casing with an upwardly opening cavity and a base lying under at least part of said cavity, a switching mechanism lying in said casing, an operating member that is moveable to operate said switching mechanism, and a light mounted on said casing and having a pair of connection members for carrying electricity, said switching mechanism including at least one switching plate with arms that are downwardly deflectable by said operating member, a plurality of conductors positioned to engage said switching plate including a conductor lying under one of said arms, wherein:

said switching plate has hole walls forming a central hole, and said connection members extend through and below a level of said hole walls.

18. The switching device described in claim 17 wherein:

said casing has an upward projection that projects into said central hole.

* * * * *